US005242031A

United States Patent [19]

Ashley

[11] Patent Number: 5,242,031

[45] Date of Patent: Sep. 7, 1993

[54] LADDER ACCESSORY

[76] Inventor: Danny R. Ashley, 8412 Dunhill La., Hixson, Tenn. 37343

[21] Appl. No.: 21,000

[22] Filed: Feb. 22, 1993

[51] Int. Cl.[5] ..... E06C 7/00

[52] U.S. Cl. ..... 182/214; 182/129

[58] Field of Search ..... 182/214, 229, 129, 107, 182/106, 116

[56] References Cited

U.S. PATENT DOCUMENTS

| | | | |
|---|---|---|---|
| 1,015,123 | 1/1912 | Bauer | 182/214 X |
| 2,327,317 | 8/1943 | Randall | 182/214 |
| 2,749,008 | 6/1956 | Wilson | 182/214 X |
| 2,797,037 | 6/1957 | Niedojadlo | 182/214 X |
| 4,159,045 | 6/1979 | Brook | 182/214 X |
| 4,643,274 | 2/1987 | Tataseo | 182/214 X |

FOREIGN PATENT DOCUMENTS

| | | | |
|---|---|---|---|
| 62203 | 5/1975 | Australia | 182/214 |

*Primary Examiner*—Alvin C. Chin-Shue
*Attorney, Agent, or Firm*—Alan Ruderman

[57] ABSTRACT

An accessory positionable on top of a ladder has a pair of brackets which may be secured about the upper ends of the ladder rails and has a laterally extending beam secured to the brackets for resting on the upper rung of the ladder. The brackets each include a leg to which laterally spaced sidewalls of a work tray are pivoted so that the tray may be rotated from an inoperative position overlaying the front of the ladder to an operative position extending transversely from the front of the ladder to the rear of the ladder, the brackets having seat portions on which the sidewalls may rest in the operative position. The rear of the work tray supports a pair of laterally slidable stabilizer arms which include a respective transversely extending limb for engaging against a wall ascended by the ladder. The spacing between the front of the ladder and the wall is thus extended by the limbs and the work tray so that one on the ladder with the accessory in the operative position may stand on a higher rung than without the accessory. A support handle may be extended out of the work tray into an operative position for additional support for one standing on the ladder, the handle being foldable into the tray when inoperative.

20 Claims, 2 Drawing Sheets

LADDER ACCESSORY

BACKGROUND OF THE INVENTION

This invention relates to ladders and more particularly to an accessory attachable to a ladder for providing a storage tray and stabilizing extension arms which permit the upper end of the ladder to be spaced further from a structure against which the ladder ascends so as to increase the usable length of the ladder, the tray and arms being readily foldable into an inoperative position against the ladder when not in use.

During use of a ladder, such as an extension ladder, the upper ends of the rails are positioned against the structure to be ascended or mounted, such as the exterior wall of a building. For safety reasons, the angle which the ladder makes with the wall must not be too sharp. Thus, the maximum height for which the ladder is usable is somewhat less than the actual length of the ladder. Additionally, one cannot safely stand on the upper few rungs of the ladder. Thus, again the maximum usable height or effective length of the ladder is reduced. Moreover, because of the angle the ladder makes with the wall, the closer one is positioned on the ladder to the upper end, the closer the person is relative to the wall against which the ladder ascends and rests. This limits the ability of the person to manipulate relative to the wall and perform functions on the ladder against the wall. For example, when painting the wall, if one is closely adjacent the upper end of the ladder, he or she may be too close to the wall to manipulate a paint brush, roller or the like. Thus, the painter must step down the ladder to a lower rung where painting may proceed. This further reduces the effective or usable length of the ladder. Because of this many people when using ladders try to extend their reach by stretching excessively thereby creating unsafe situations. Many a person has fallen after having reached or stretched too far.

When one has ascended a ladder and is positioned at an elevation where his or her hands are substantially above the upper ends of the rung, there is nothing which may be grasped for stability except for the wall against which the ladder rests. Thus, the user must try to balance himself on the rung without holding on to the ladder. Obviously this is an exceptionally dangerous safety condition. To grasp the end of the rail for stability requires the user to drop down to a lower rung. This too reduces the effective length of the ladder.

Furthermore, it is often desirable to position a tray or the like adjacent to where the user of the ladder is positioned. To this end it is known to provide a tray including paint roller trays having clip means for removable attachment to rungs of the ladder. The clips in the known units of this type generally do not provide great stability and also may not be adapted for rungs of various cross sectional configurations.

SUMMARY OF THE INVENTION

Consequently, it is a primary object of the present invention to provide an accessory attachable to a ladder that extends the usable or effective height of the ladder.

It is another object of the present invention to provide an accessory attachable to the end of the rails of a ladder and which has stabilizer arms that project transversely relative to the ladder for abutting the structure to be ascended and against which the end of the ladder normally would abut, the accessory including a storage tray and having an upwardly extending handle which may be grasped by one using the ladder.

It is a further object of the present invention to provide an accessory for a ladder including a pair of brackets attachable to the free ends of the rails of the ladder, each bracket carrying a lateral support member which projects transversely relative to the ladder, the support members in turn supporting adjustable stabilizer arms disposed for abutting the structure to be mounted, the support members also carrying a work tray and a support handle, the handle being foldable into the tray and the tray being rotatable into a stored position against the ladder when inoperative.

Accordingly, the present invention provides a ladder accessory positionable on top of a ladder having a pair of brackets disposed for connecting about the upper ends of the ladder rails and having a cross member laterally spanning the brackets for resting on the upper rung of the ladder. The brackets each include a forwardly extending leg to which the laterally spaced sides of a work tray are pivotably journalled so that the tray may be rotated from an inoperative position overlaying the front of the ladder to an operative position extending transversely toward the rear of the ladder and resting on portions of the brackets. The rear of the work tray sides each receive a laterally extending stabilizer arm and are connected to a laterally extending enclosure for slidably receiving the arms which are adjustable laterally, the arms having limbs which extend transversely rearwardly from the ladder and work tray for abutting the wall structure against which the ladder is supported. The transverse length of the limbs together with the length of the sides of the tray provide a front to rear extension spacing the ladder further relative to the wall structure so that the user may stand on a higher rung than otherwise possible thereby effectively increasing the usable height of the ladder while greater stability is provided as a result of the lateral extension of the legs. At the rear of the work tray are bracket means to which a handle is pivotally mounted, the handle being pivoted and locked between an operative upstanding position relative to the tray and an inoperative position folded into the tray. In the operative position the handle may be grasped and held by the user of the ladder to provide support while the user's hands are substantially above the upper rung.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figures 1, 4:
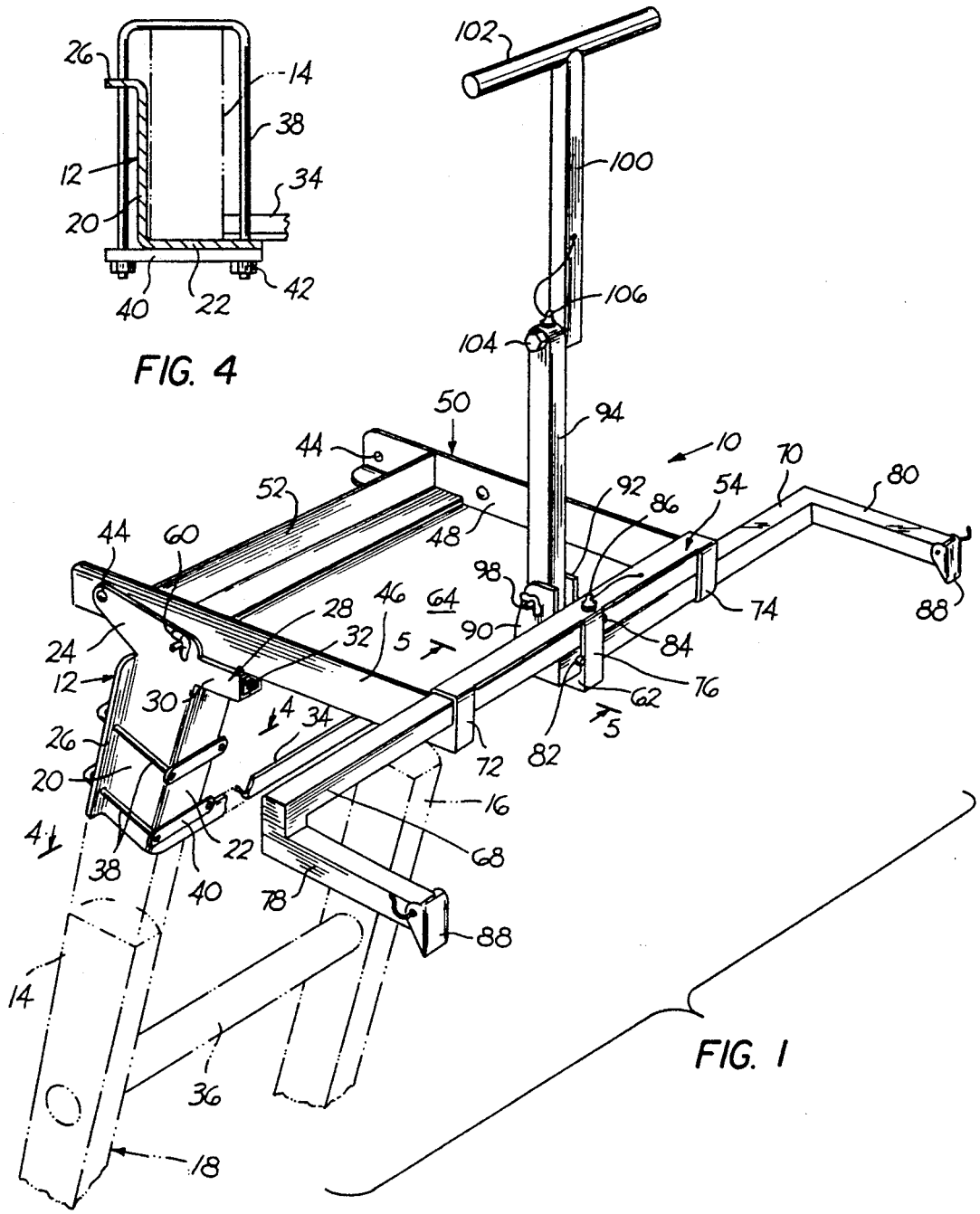
FIG. 1 is a rear perspective view of a ladder accessory constructed in accordance with the principles of the present invention, the elements of the accessory being illustrated in the operative positions.
FIG. 4 is a cross sectional view taken substantially along line 4—4 of FIG. 1.

Referring now to the drawings, a ladder accessory 10 constructed in accordance with the present invention includes a pair of spaced apart mounting brackets 12 (only one of which is illustrated), each bracket adapted to be disposed in abutment with and secured to a respective rail 14, 16 of a ladder 18. As best illustrated in FIG. 4, each bracket 12 comprises a unitary member having a substantially Z-shaped cross sectional configuration preferably constructed from aluminum sheet metal. The central leg 20 of the bracket is adapted to abut the laterally facing exterior face of the respective rail 14, 16 while one of the other legs, e.g., leg 22 abuts the rear face of the rail. Above the location where the brackets abut the rails, each bracket includes a protuberance 24 extending forwardly from the leg 20 over the front leg 26 of the respective bracket 12, while a small rearwardly extending protuberance 28 extends over the leg 22. While the front protuberance 24 may preferably be merely a laterally facing ply of the sheet metal material, the rear protuberance 28 preferably includes a lateral wall 30 substantially coplanar with the leg 20 and a laterally extending wall 32 bent out of the plane of the wall 30 so that the end of the protuberance 28 forms a foot and the upper surface of the wall 32 forms a seat for reasons hereinafter made clear.

A laterally extending substantially L-shape angle beam 34 preferably is fastened to and spans the brackets 12 at the legs 22 and when the brackets are mounted on the ladder about the upper ends of the rails 14, 16 the beam 34 is disposed on the upper rung 36 of the ladder to secure and position the brackets vertically. Additionally, the brackets may be secured to the rails in the front to rear transverse direction by a pair of U-bolts 38 which extend about each rail and have one leg parallel to the leg 20 and received through apertures in the bracket leg 26. The other leg of each U-bolt extends parallel to the interior surface of the ladder rail and may extend through the leg 22. The ends of the legs of each U-bolt may then pass through and be tied together by a bar 40 and secured thereto by nuts 42. Thus, the brackets 12 as a pair connected together by means of the angle beam 34 may be secured to the upper end of the ladder rails.

Figure 5:
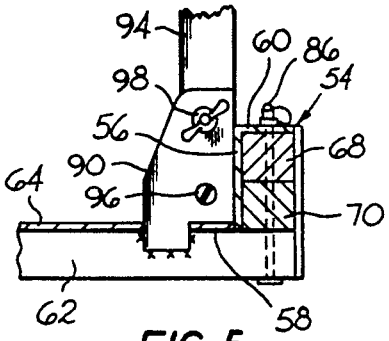
FIG. 5 is a cross sectional view taken substantially along line 5—5 of FIG. 1.

Pivotally connected by means of a respective journal pin 44 relative to the protuberance 24 of each bracket 12 is a respective sidewall 46, 48 of a work tray 50, each sidewall preferably being formed from an aluminum angle beam. A front wall 52 of the tray preferably also in the form of an angle beam is fastened to the walls 46 and 48 preferably spaced rearwardly from the journal pins 44 while the rear wall of the tray preferably comprises a Z-shaped bar 54 as best illustrated in FIG. 5, the bar 54 having a central leg 56, which is upstanding in the operative position of the tray, and lower and upper legs 58 and 60 respectively extending from the central leg.

Figure 2:
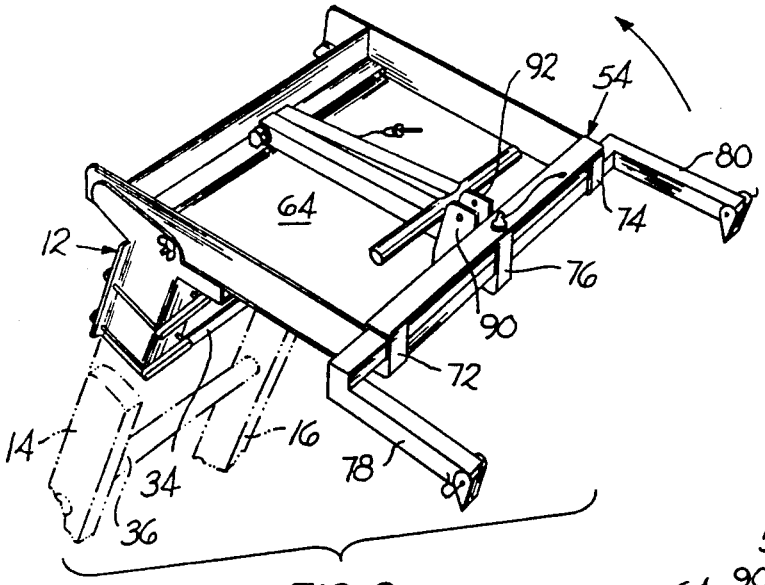
FIG. 2 is a view similar to FIG. 1 but with the handle folded into the work tray and the stabilizing arms being illustrated in a retracted position.
Figure 3:
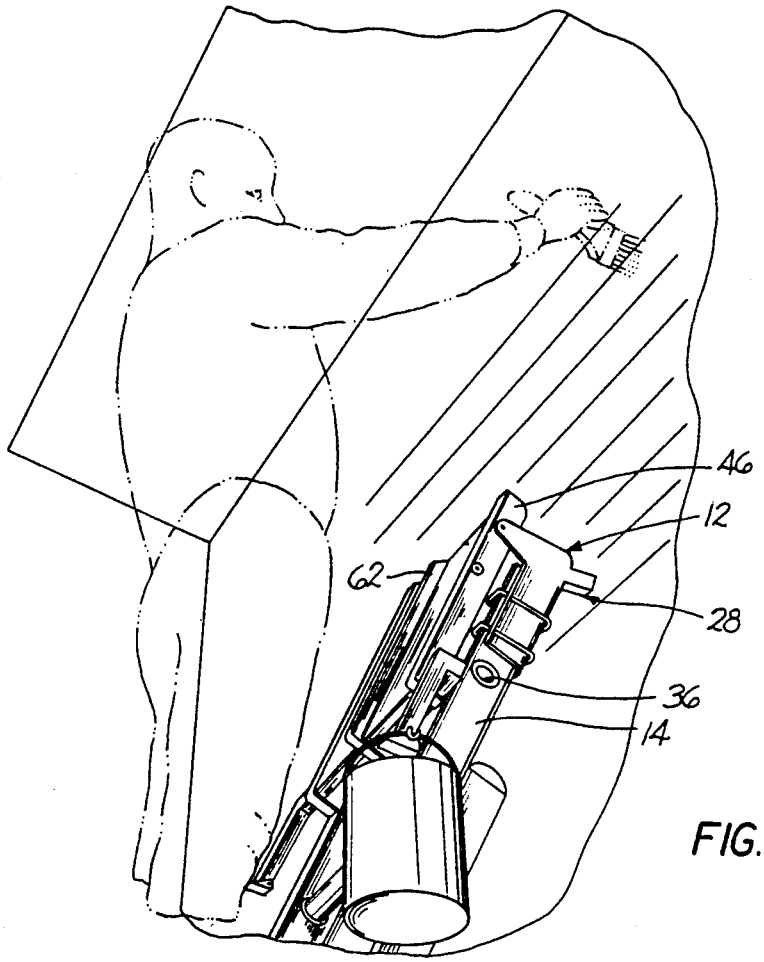
FIG. 3 is a front perspective view illustrating the accessory mounted on a ladder but with the elements thereof being illustrated in the inoperative or stored position.

A support beam 62 is secured as by welding or the like to the center of the front wall 52 and the center of the lower leg 58 of the rear wall of the tray, the rear of the beam 62 extending rearwardly of the leg 58 beneath the leg 60. An aluminum or plastic sheet 64 is positioned in the inside of the tray to overlay the beam 62 and abut portions of the front, rear and sidewalls to form a work tray support surface. By virtue of the pivotal connection of the sidewalls of the tray to the brackets 12, the work tray may be rotated from a stored position overlaying the front of the bracket leg 26, and thus the front of the ladder with the walls 46, 48 substantially parallel to the rails 14, 16 as illustrated in FIG. 3, to an operative position wherein the sidewalls are positioned on the seat formed by the upper surface of the wall 32 of the rearwardly extending protuberance 28 as illustrated in FIGS. 1 and 2. The tray may be held in the operative position by a locking pin or screw 66 passing through the sidewalls and the bracket protuberance 24 rearwardly of the journal pin 44 and secured by means of a wing nut or the like.

The rear end of each tray sidewall 46, 48 includes an opening through which a respective laterally extending stabilizer arm 68, 70 may be received. The arms are disposed in overlapping relationship one above the other so that the opening in the side wall 46 is offset relative to that in the sidewall 48. Both arms 68, 70 are received within an enclosure formed by the upstanding central leg 56 and the upper leg 60 of the Z-shaped beam forming the rear wall 54 of the tray, the rear extension of the beam 62, and closure members 72, 74, 76 welded to the upper leg 60 and the ends of the sidewalls 46, 48 and the beam 62 respectively. The stabilizer arms 68 and 70 may then slide within the enclosure relative to each other and relative to the tray 50.

Each stabilizer arm 68, 70 includes a respective limb 78, 80 extending from the arm directed remote from the work tray 50. The limbs preclude the outer ends of the arms from being pulled toward one another through the enclosure while stop members 82, 84 on each respective arm acts to abut the closure member 76 for precluding the arms from being pulled in the opposite direction free of the enclosure. Thus, the arms may be positioned in a fully extended position as illustrated in FIG. 1 where the limbs 78 and 80 are at a maximum spacing from the respective sidewall 46, 48 of the tray, to a fully retracted position as illustrated in FIG. 3, wherein the limbs abut the respective sidewalls 46, 48. Other positions such as illustrated in FIG. 2 may be selected. In at least the fully extended position a locking pin 86 may be received through aligned holes in the upper leg 60 of the bar 54, the arms 68 and 70, and the support beam 62 to maintain the arms in position. Other holes may be formed in the arms 68 and 70 to secure the arms in other selected positions. A pivotally mounted preferably spring biased finger 88 may be mounted on the free end of each limb 78, 80 to provide a large bearing surface for abutting the wall against which the ladder is being used, the pivotal mounting permitting adjustment of the abutment angle of the limbs with the wall and may be useful when the ladder mounted accessory is used against the surface of a roof.

Fastened to the legs 56 and 58 of the rear wall 54 within the tray 50 and to the lateral surfaces of the support beam 62 is a pair of spaced apart plate members 90, 92 which extend upwardly from the tray work surface 64. A preferably rectangular aluminum tube 94 is disposed between and pivotally journalled to the plate members on a pin or the like 96 for movement between an operative position upstanding relative to the tray surface 64 and a folded inoperative position within the tray, the length of the tube 94 being no longer than the spacing between the front and rear walls of the tray. A securing bolt or the like 98 extending through the plate members 90, 92 may lock the tube in the operative position so that it does not fold inadvertently. Another tube member 100 having a handle 102 at one end is pivotally fastened by a hinge pin 104 at its other end adjacent to the free end of the tube 94 so that the two tubes may fold alongside one another when inoperative for storage within the tray as illustrated in FIG. 2, and the tube 100 may be disposed upstanding relative to the tube 94 when in the operative position as illustrated in FIG. 1. In the operative position a lock pin 106 may extend through the hinge pin 104 to preclude pivoting of the upper tube member 100 relative to the lower tube member so that the handle 102 may be grasped by one on the ladder for support.

It may thus be seen that the ladder accessory may be attached to the rails of a ladder and secured thereto with the stabilizing arms laterally extended. The transverse or front to rear length of the limbs 78 and 80 together with the length of the sidewalls 46, 48 of the tray 50 thus positions the upper end of the ladder further from the work surface such as the wall of a building. A workman on the ladder may therefore stand on a higher rung than otherwise since the workman will not be cramped against the wall. The stabilizer arms provide additional stabilization for the ladder with the workman in an upper position, and the workman may grasp the handle 102 for additional support. Work items may be placed within the tray 50 so as to be readily accessible to the workman. When the accessory is not in use, the handle tube members 94 and 100 fold into the tray, the stabilizing arms retracted, and the tray rotated out of the transverse position into a position overlaying the ladder and depending downwardly from the bracket members 12 as illustrated in FIG. 3. When the ladder is not in use, the accessory may remain on the ladder in the inoperative position. By constructing the accessory from aluminum, a minimum amount of weight is added to the ladder. In the inoperative position illustrated in FIG. 3, the ladder may be used in the conventional manner disposed slightly from the wall of the building by means of the feet 28 of the bracket members 12.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An accessory for a ladder having a pair of laterally spaced apart rails interconnected by laterally extending rungs, said rails having free ends at the top of said ladder spaced from the uppermost rung, said accessory comprising a pair of laterally spaced apart brackets positionable about at least a portion of said free ends of said rails, means for securing said brackets to said rails, a work tray including a support surface, journal means for pivotally connecting said work tray to said bracket for pivoting between a stowed position with said surface disposed in a plane substantially parallel to said rails overlaying said ladder and an operative position with said surface disposed in a plane transverse to said rails, a pair of stabilizer arms, mounting means carried by said work tray for mounting said arms for lateral movement relative to said tray, each of said arms including a respective limb extending substantially parallel to said rails when said tray is in said stowed position and extending transversely to said ladder when said tray is in said operative position for abutting a surface ascended by said ladder, a handle, means for hingedly mounting said handle for extending outwardly from said tray when said tray is in said operative position and for permitting said handle to be folded into said tray when said tray is in said stowed position, and means for locking said tray, said arms and said handle against movement when said tray is in said operative position.

2. An accessory as recited in claim 1, wherein each of said brackets includes a first protuberance extending transversely relative to said rails in a first direction, said journal means being disposed in said first protuberance.

3. An accessory as recited in claim 2, wherein each of said brackets includes a second protuberance extending transversely relative to said rails in a second direction opposite to said first direction, said second protuberance having a seat for supporting said work tray when in said operative position, and said second protuberance including an abutment member for abutting the surface ascended by said ladder when said tray is in said inoperative position.

4. An accessory as recited in claim 1, wherein said tray includes a pair of sidewalls and a transversely extending wall fastened to said sidewalls, said journal means connecting said sidewalls to a respective bracket remote from said transversely extending wall.

5. An accessory as recited in claim 4, wherein said mounting means comprises means for slidably receiving said arms within a portion of said transversely extending wall and for receiving one arm in each of said sidewalls.

6. An accessory as recited in claim 5, wherein each of said brackets includes a first protuberance extending transversely relative to said rails in a first direction, said journal means being disposed in said first protuberance.

7. An accessory as recited in claim 6, wherein each of said brackets includes a second protuberance extending transversely relative to said rails in a second direction opposite to said first direction, said second protuberance having a seat for supporting said work tray when in said operative position, and said second protuberance including an abutment member for abutting the surface ascended by said ladder when said tray is in said inoperative position.

8. An accessory as recited in claim 1, wherein said means for hingedly mounting said handle includes a first elongated member having first and second ends, pivot means for pivotally mounting the first end of said first elongated member in said tray for movement from a stored position within said tray overlaying said support surface to an operative position extending from said support surface out of said tray, a second elongated member having two ends, said handle being disposed on one end of said second member, and means for pivotally mounting the other end of said second member to said second end of said first member in a lateral disposition such that said first and second elongated members may be folded into side-by-side within said tray and both elongated members may be extended into said operative position.

9. An accessory as recited in claim 8, wherein each of said brackets includes a first protuberance extending transversely relative to said rails in a first direction, said journal means being disposed in said first protuberance.

10. An accessory as recited in claim 9, wherein each of said brackets includes a second protuberance extending transversely relative to said rails in a second direction opposite to said first direction, said second protuberance having a seat for supporting said work tray when in said operative position, and said second protuberance including an abutment member for abutting the surface ascended by said ladder when said tray is in said inoperative position.

11. An accessory as recited in claim 8, wherein said tray includes a pair of sidewalls and a transversely extending wall fastened to said sidewalls, said journal means connecting said sidewalls to a respective bracket remote from said transversely extending wall.

12. An accessory as recited in claim 11, wherein said mounting means comprises means for slidably receiving said arms within a portion of said transversely extending wall and for receiving one arm in each of said sidewalls.

13. An accessory as recited in claim 12, wherein each of said brackets includes a first protuberance extending transversely relative to said rails in a first direction, said journal means being disposed in said first protuberance.

14. An accessory as recited in claim 13, wherein each of said brackets includes a second protuberance extending transversely relative to said rails in a second direction opposite to said first direction, said second protuberance having a seat for supporting said work tray when in said operative position, and said second protuberance including an abutment member for abutting the surface ascended by said ladder when said tray is in said inoperative position.

15. An accessory as recited in claim 1, including a laterally extending beam secured to said brackets for positioning on a rung adjacent said top of said ladder when said brackets are secured to said rails.

16. An accessory as recited in claim 15, wherein each of said brackets includes a first protuberance extending transversely relative to said rails in a first direction, said journal means being disposed in said first protuberance.

17. An accessory as recited in claim 16, wherein each of said brackets includes a second protuberance extending transversely relative to said rails in a second direction opposite to said first direction, said second protuberance having a seat for supporting said work tray when in said operative position, and said second protuberance including an abutment member for abutting the surface ascended by said ladder when said tray is in said inoperative position.

18. An accessory as recited in claim 17, wherein said tray includes a pair of sidewalls and a transversely extending wall fastened to said sidewalls, said journal means connecting said sidewalls to a respective bracket remote from said transversely extending wall.

19. An accessory as recited in claim 18, wherein said mounting means comprises means for slidably receiving said arms within a portion of said transversely extending wall and for receiving one arm in each of said sidewalls.

20. An accessory as recited in claim 19, wherein said means for hingedly mounting said handle includes a first elongated member having first and second ends, pivot means for pivotally mounting the first end of said first elongated member in said tray for movement from a stored position within said tray overlaying said support surface to an operative position extending from said support surface out of said tray, a second elongated member having two ends, said handle being disposed on one end of said second member, and means for pivotally mounting the other end of said second member to said second end of said first member in a lateral disposition such that said first and second elongated members may be folded into side-by-side within said tray and both elongated members may be extended into said operative position.

* * * * *